US008202043B2

(12) United States Patent
McCaffrey

(10) Patent No.: US 8,202,043 B2
(45) Date of Patent: Jun. 19, 2012

(54) GAS TURBINE ENGINES AND RELATED SYSTEMS INVOLVING VARIABLE VANES

(75) Inventor: Michael G. McCaffrey, Windsor, CT (US)

(73) Assignee: United Technologies Corp., Hartford, CT (US)

( * ) Notice: Subject to any disclaimer, the term of this patent is extended or adjusted under 35 U.S.C. 154(b) by 1151 days.

(21) Appl. No.: 11/872,156

(22) Filed: Oct. 15, 2007

(65) Prior Publication Data

US 2009/0097966 A1 Apr. 16, 2009

(51) Int. Cl.
*F01D 9/00* (2006.01)

(52) U.S. Cl. ..... 415/160; 415/161

(58) Field of Classification Search ..... 415/161, 415/191, 209.3, 209.4, 210.1
See application file for complete search history.

(56) References Cited

U.S. PATENT DOCUMENTS

| | | | | |
|---|---|---|---|---|
| 3,224,194 | A | 12/1965 | De Feo et al. | |
| 3,314,654 | A | 4/1967 | Spencer et al. | |
| 3,558,237 | A | 1/1971 | Wall, Jr. | |
| 3,850,544 | A * | 11/1974 | Ciokajlo | 415/149.4 |
| 3,990,810 | A * | 11/1976 | Amos et al. | 415/161 |
| 3,995,971 | A | 12/1976 | White | |
| 3,999,883 | A * | 12/1976 | Nordenson | 415/113 |
| 4,013,377 | A * | 3/1977 | Amos | 415/161 |
| 4,856,962 | A | 8/1989 | McDow | |
| 5,549,448 | A | 8/1996 | Langston | |
| 5,931,636 | A * | 8/1999 | Savage et al. | 415/115 |
| 6,381,933 | B1 * | 5/2002 | Wanner et al. | 56/13.5 |
| 6,592,326 | B2 | 7/2003 | Marx et al. | |
| 6,680,717 | B2 * | 1/2004 | Tanaka | 345/60 |
| 6,783,323 | B2 | 8/2004 | Shiozaki et al. | |
| 6,910,855 | B2 * | 6/2005 | Dailey et al. | 415/151 |
| 6,984,104 | B2 | 1/2006 | Alexander et al. | |
| 7,008,178 | B2 | 3/2006 | Busch et al. | |
| 7,011,494 | B2 | 3/2006 | Kies et al. | |
| 7,101,150 | B2 | 9/2006 | Bash et al. | |
| 7,140,835 | B2 | 11/2006 | Lee et al. | |
| 7,195,454 | B2 | 3/2007 | Lu et al. | |
| 2004/0240989 | A1 | 12/2004 | Willshee | |
| 2009/0053037 | A1 | 2/2009 | Marini | |

OTHER PUBLICATIONS

EP Search Report for EP 08253338.1, Dec. 16, 2011.

* cited by examiner

*Primary Examiner* — Ninh H Nguyen

(57) ABSTRACT

Gas turbine engines and related systems involving variable vanes are provided. In this regard, a representative vane assembly for a gas turbine engine includes: a first inner diameter platform; a first outer diameter platform spaced from the first inner diameter platform; and a variable vane airfoil rotatably attached to and extending between the first inner diameter platform and the first outer diameter platform such that at least a portion of the vane airfoil extends beyond a periphery of at least one of the first inner diameter platform and the first outer diameter platform.

17 Claims, 3 Drawing Sheets

GAS TURBINE ENGINES AND RELATED SYSTEMS INVOLVING VARIABLE VANES

BACKGROUND

1. Technical Field

The disclosure generally relates to gas turbine engines.

2. Description of the Related Art

Many gas turbine engines incorporate variable stator vanes, the angle of attack of which can be adjusted. Conventionally, implementation of variable vanes involves providing an annular array of vane airfoils, with each of the vane airfoils being attached to a spindle. The spindles extend radially outward through holes formed in the engine casing in which the vane airfoils are mounted. Each of the spindles is connected to a lever arm that engages a unison ring located outside the engine casing. In operation, movement of the unison ring pivots the lever arms, thereby rotating the spindles and vane airfoils.

SUMMARY

Gas turbine engines and related systems involving variable vanes are provided. In this regard, an exemplary embodiment of a vane assembly for a gas turbine engine comprises: a first inner diameter platform; a first outer diameter platform spaced from the first inner diameter platform; and a variable vane airfoil rotatably attached to and extending between the first inner diameter platform and the first outer diameter platform such that at least a portion of the vane airfoil extends beyond a periphery of at least one of the first inner diameter platform and the first outer diameter platform.

An exemplary embodiment of a variable vane for a gas turbine engine comprises: a shaft having a first end and a second end; a vane airfoil attached to the shaft between the first end and the second end; a tapered spline located between the airfoil and the second end, the spline being configured such that a narrow portion of the spline is located toward the second end.

An exemplary embodiment of a gas turbine engine comprises: a compressor; a combustion section operative to receive compressed air from the compressor; a turbine operative to drive the compressor, the turbine having a vane assembly; the vane assembly comprising: a first inner diameter platform; a first outer diameter platform spaced from the first inner diameter platform; and a variable vane airfoil rotatably attached to and extending between the first inner diameter platform and the first outer diameter platform such that at least a portion of the vane airfoil extends beyond a periphery of at least one of the first inner diameter platform and the first outer diameter platform.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engines and related systems involving variable vanes are provided, several exemplary embodiments of which will be described in detail. In this regard, some embodiments involve the use of a variable vane airfoil that spans at least a portion of a gap formed between adjacent vane platforms. By positioning the vane airfoil in such a manner, the vane tends to block radial gas leakage through the platform gap.

Figure 1:
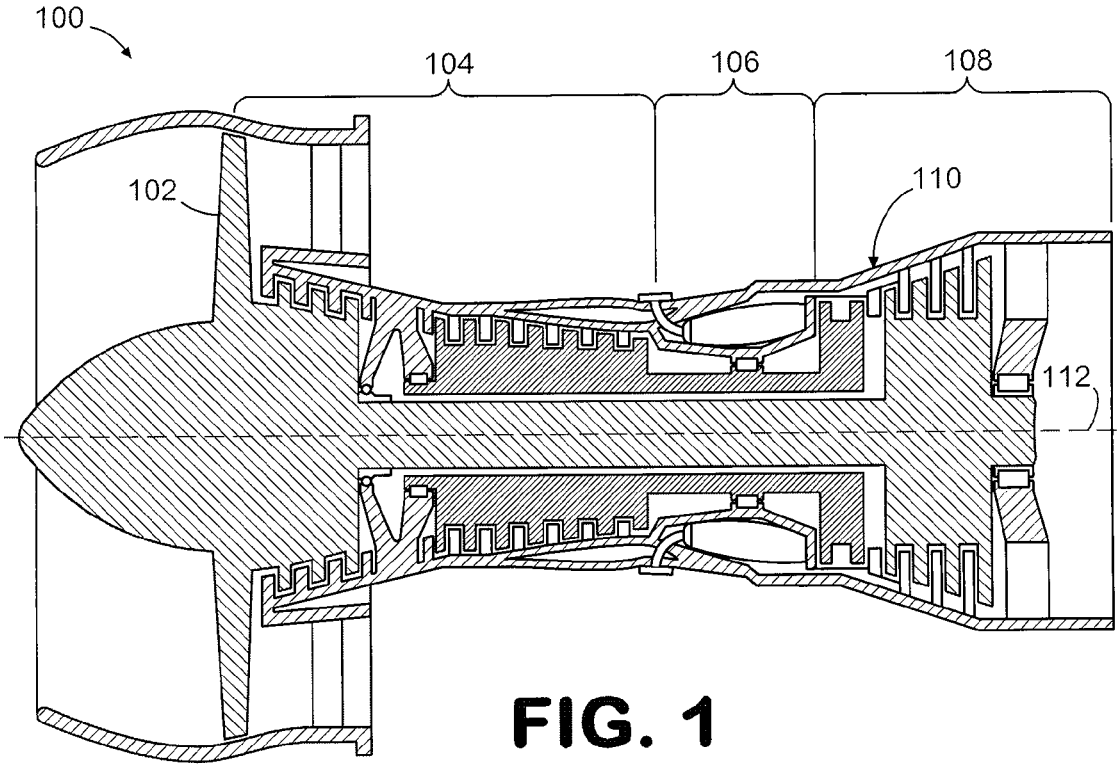
FIG. 1 is a schematic diagram depicting an exemplary embodiment of a gas turbine engine.

FIG. 1 is a schematic diagram depicting an exemplary embodiment of a gas turbine engine. As shown in FIG. 1, engine 100 incorporates a fan 102, a compressor section 104, a combustion section 106 and a turbine section 108. Engine 100 also incorporates a variable vane assembly 110. Although depicted in FIG. 1 as being positioned between a low-pressure turbine and a high-pressure turbine, various other locations of a variable vane assembly can be used in other embodiments. Additionally, although depicted in FIG. 1 as a turbofan gas turbine engine, there is no intention to limit the concepts described herein to use with turbofans as other types of gas turbine engines can be used.

Figure 2:
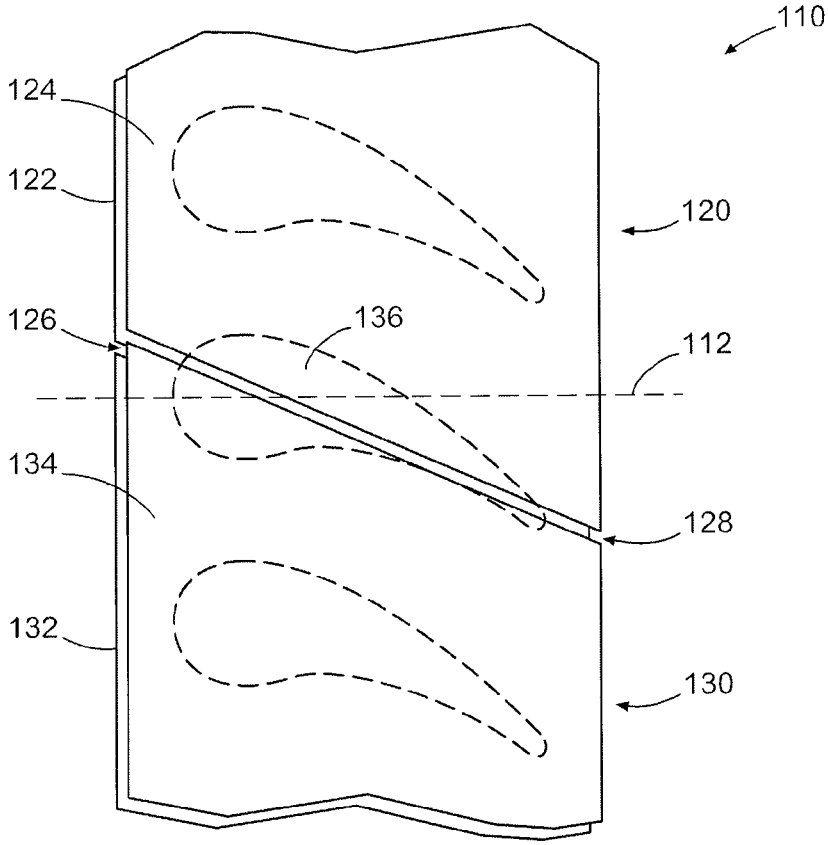
FIG. 2 is a partially cut-away, schematic diagram depicting a portion of the vane assembly of the embodiment of FIG. 1.

With reference to the partially cut-away, schematic diagram of FIG. 2, vane assembly 110 includes an annular arrangement of vanes positioned about a longitudinal axis 112. Inner and outer diameter platforms of the vanes mount vane airfoils. By way of example, vanes 120 and 130 include inner diameter platforms 122, 132, respectively, and outer diameter platforms 124, 134, respectively. Vane airfoils (e.g., airfoil 136) extend radially across the annulus located between the inner and outer platforms. Notably, in contrast to being positioned entirely within the periphery defined by the platforms of a single vane, airfoil 136 extends beyond the periphery of platforms 132, 134.

In the embodiment of FIG. 2, an inner platform gap 126 is located between adjacent inner platforms 122, 132, and an outer platform gap 128 is located between adjacent outer platforms 124, 134. Airfoil 136 obstructs at least a portion of each of the gaps. In some embodiments, the length of the gap spanned can be as much as a chord length of the airfoil. In those embodiments in which the airfoil obstructing the gap is a variable vane, the vane length of the gaps being spanned can vary depending upon the rotational positioning of the airfoil. Notably, the gap can be oriented in various manners relative to the longitudinal axis of the engine. For instance, in the embodiment of FIG. 2, the gap is not parallel with longitudinal axis 112.

Figure 3:
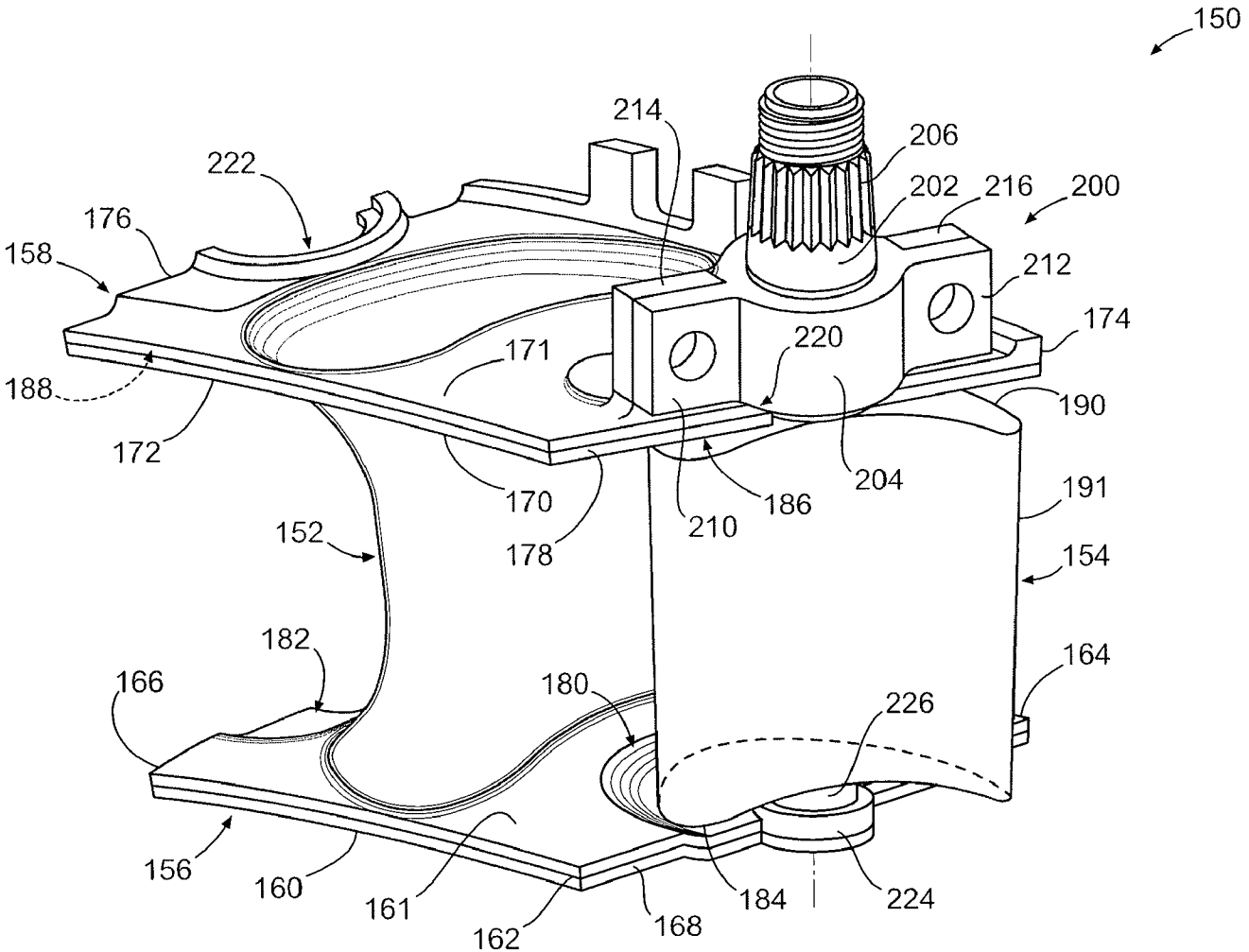
FIG. 3 is a schematic diagram depicting an exemplary embodiment of a vane assembly.

An exemplary embodiment of a vane is depicted in FIG. 3. As shown in FIG. 3, vane 150 is configured as a doublet incorporating two vane airfoils. Specifically, airfoil 152 is a stationary airfoil, whereas airfoil 154 is a variable airfoil. In other embodiments, various other numbers and configurations of airfoils can be used.

The vane airfoils 152, 154 extend between an inner diameter platform 156 and an outer diameter platform 158. Platform 156 includes an inner diameter surface 160, an outer diameter surface 161, a forward edge 162, an aft edge 164, and side edges 166, 168 that extend between the forward and aft edges. Platform 158 includes an inner diameter surface 170, an outer diameter surface 171, a forward edge 172, an aft edge 174, and side edges 176, 178 that extend between the forward and aft edges.

Outer diameter surface 161 of the inner platform and inner diameter surface 170 of the outer platform incorporate recesses that are configured to receive corresponding ends of variable airfoils. In particular, surface 161 of the inner platform includes a suction-side root recess 180 that intersects side edge 168, and a pressure-side root recess 182 that intersects side edge 166. Suction-side root recess 180 is sized and shaped to receive the root 184 of airfoil 154, whereas pressure-side root recess 182 is sized and shaped to receive the root of an adjacent variable airfoil (not shown). Surface 170 of the outer platform includes a suction-side root recess 186 that intersects side edge 178, and a pressure-side root recess 188 that intersects side edge 176. Suction-side root recess 186 is sized and shaped to receive the tip 190 of airfoil 154, whereas pressure-side root recess 188 is sized and shaped to receive the tip of an adjacent variable airfoil (not shown).

By placing the airfoil 154 on the suction side of airfoil 152, the sweep of the trailing edge 191 of the variable vane can be contained within the vane 150. Such a configuration tends to ensure that vane-to-vane variations do not affect the leak path located between adjacent vanes.

Vane airfoil 154 is a portion of a variable vane 200 that includes a shaft 202 and a bearing 204. In the embodiment of FIG. 3, the shaft is a hollow shaft that extends through the airfoil from an outer diameter portion of the shaft (located near the tip of the airfoil) to an inner diameter portion of the shaft (located near the root of the airfoil). The hollow shaft receives a flow of cooling air for cooling the vane airfoil. In some embodiments, cooling air is directed from the outer diameter portion of the shaft through to the inner diameter portion of the shaft.

In other embodiments, cooling air can be provided through stationary airfoil 152, such as from the outer diameter to the inner diameter. From the inner diameter of the stationary vane, the cooling air can be routed to the inner diameter portion of the shaft and then outwardly to the outer diameter portion. Such a configuration can reduce the size requirements of the hollow portion of the shaft at the outer diameter, thereby permitting the use of a narrower shaft and associated components. Additional cooling can be provided by the platform gaps formed between adjacent platforms of adjacent vanes.

Shaft 202 includes a tapered spline 206, with bearing 204 being located between the airfoil and the spline. The spline is operative to receive torque for positioning the variable vane. That is, rotation of the shaft via the spline pivots the airfoil. Notably, use of a tapered spline may promote engagement of spline teeth of the shaft with those of an actuation arm (not shown), thereby eliminating a source of hysteresis.

Bearing 204 is configured as a pillow block in the embodiment of FIG. 3. Bearing 204 incorporates flanges 210, 212 that engage corresponding flanges 214, 216 located on the outer diameter surface of the outer platform 158. So engaged, the shaft is received by a split aperture 220 formed in side edge 178 of the outer diameter platform. A corresponding split aperture 222 is formed in side edge 176 that receives a portion of a shaft of a variable vane of an adjacent vane (not shown). The inner diameter platform incorporates a bearing 224 that receives distal end 226 of the shaft 202.

In some embodiments, bearing 224 can be configured as a cartridge bearing and/or contain a spherical bearing. It should be noted that by providing a spherical surface, misalignment of the inner diameter and outer diameter platforms should not induce a bending moment on the on airfoil 154.

As mentioned before, multiple vanes typically are configured in an annular arrangement of vanes to form a vane assembly. The vane assembly defines an annular gas flow path between the vanes and platforms. Multiple vanes similar in construction to vane 150 can be provided in such an assembly. As such, the annular arrangement includes alternating stationary and variable airfoils.

Figure 4:
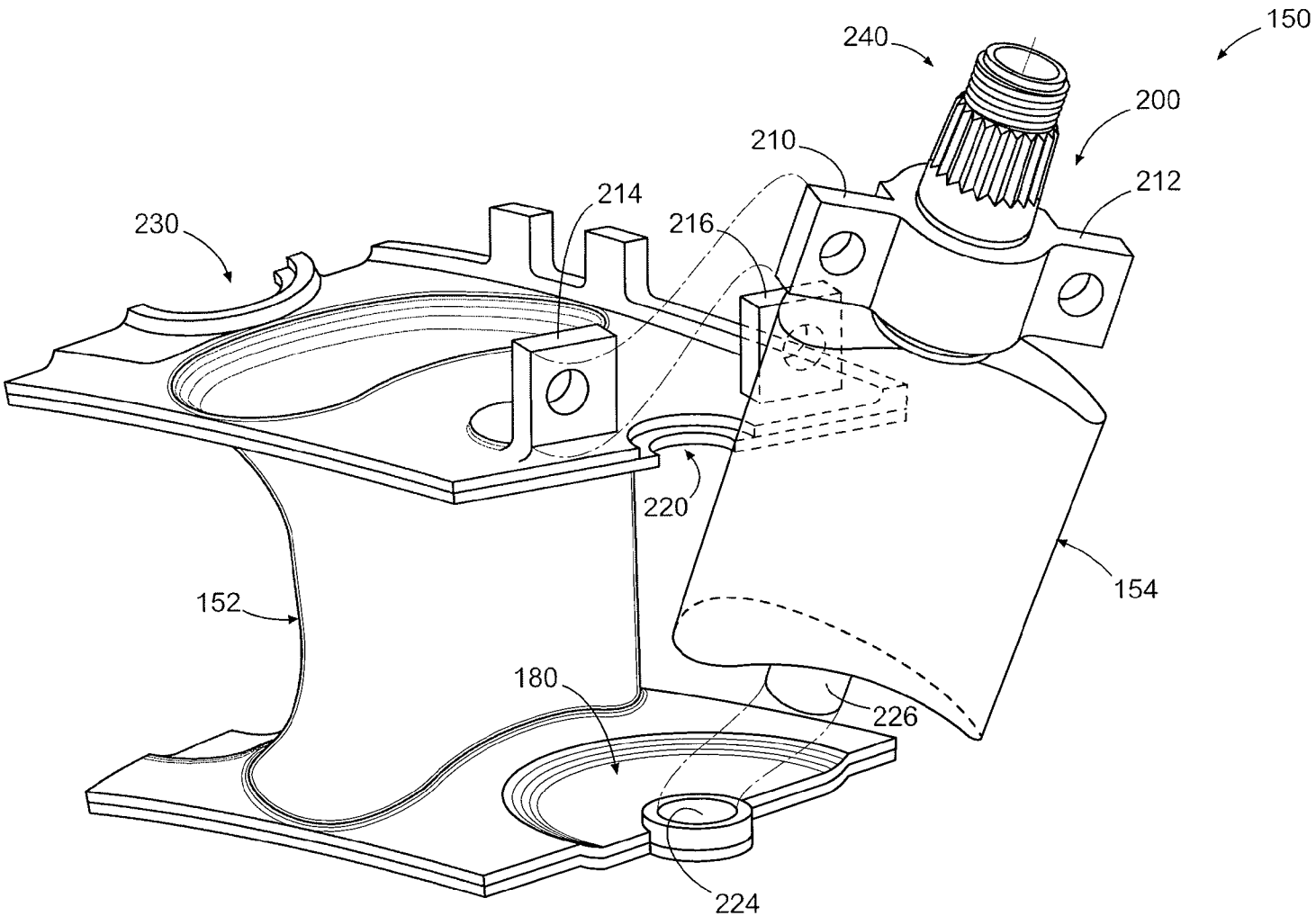
FIG. 4 is a schematic diagram depicting assembly detail of the embodiment of FIG. 3.

Assembly detail of the embodiment of FIG. 3 is shown in the schematic diagram of FIG. 4. As shown in FIG. 4, stationary portions of the vane are provided as an assembly 230 that is adapted to receive variable vane 200. Locating the variable vane at the side edges of the platforms enables the distal end 226 of the shaft to be received by the bearing. The free end 240 of the shaft then can be pivoted about the distal end so that flanges of the pillow block engage corresponding flanges of the outer diameter platform. This also enables the root and tip of the airfoil 154 to be received within corresponding recesses of the platforms.

Since the variable vane is configured as a removable portion of the vane assembly, the variable vane can be separately formed from the assembly. This can result in relative ease of manufacture. Notably, various materials can be used to form a variable vane and/or associated vane airfoil such as ceramic, Ceramic Matrix Composite (CMC), metals and/or metal alloys, e.g., nickel-based superalloy.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

What is claimed is:

1. A vane assembly for a gas turbine engine comprising:

a first inner diameter platform having an outer diameter surface and a recess located in the outer diameter surface;

a first outer diameter platform spaced from the first inner diameter platform; and a variable vane airfoil rotatably attached to and extending between the first inner diameter platform and the first outer diameter platform such that at least a portion of the vane airfoil extends beyond a periphery of at least one of the first inner diameter platform and the first outer diameter platform, wherein a root of the vane airfoil extends into the recess, and wherein the root comprises an airfoil cross-sectional geometry.

2. The assembly of claim 1, wherein:

each of the first inner diameter platform and the first outer diameter platform has a front edge, an aft edge and a side edge extending between the front edge and the aft edge; and at least a portion of the vane airfoil extends beyond the side edge of at least one of the first inner diameter platform and the first outer diameter platform.

3. The assembly of claim 1, wherein:

the recess is a suction-side recess; and at least a portion of the root associated with a suction side of the vane airfoil extends into the suction-side recess.

4. The assembly of claim 1, further comprising:

a second inner diameter platform; and a second outer diameter platform spaced from the second inner diameter platform;

the second inner diameter platform being positioned adjacent to the first inner diameter platform such that an inner platform gap is formed therebetween;

the second outer diameter platform being positioned adjacent to the first outer diameter platform such that an outer platform gap is formed therebetween; and the vane airfoil spanning across at least a portion of the inner platform gap and across at least a portion of the outer platform gap.

5. The assembly of claim 4, wherein:

the second inner diameter platform has a pressure-side recess; and at least a portion of the root associated with a pressure side of the vane airfoil extends into the pressure-side recess.

6. The assembly of claim 1, wherein:

the vane airfoil is a first vane airfoil; and the assembly further comprises a second vane airfoil extending between the first inner diameter platform and the first outer diameter platform.

7. The assembly of claim 6, wherein the second vane airfoil is a stationary airfoil fixed in position with respect to the first inner diameter platform and the first outer diameter platform.

8. The assembly of claim 1, wherein the vane airfoil is a portion of a variable vane assembly having a shaft, the vane airfoil being attached to the shaft such that the airfoil rotates with the shaft.

9. The assembly of claim 8, wherein:

the first inner diameter platform supports an inner diameter bearing; and a free end of the shaft is received by the inner diameter bearing.

10. The assembly of claim 8, wherein the shaft is a hollow shaft operative to receive cooling air for cooling the vane airfoil.

11. The assembly of claim 8, wherein the shaft has a tapered spline.

12. A vane assembly for a gas turbine engine comprising:

a first inner diameter platform;

a first outer diameter platform spaced from the first inner diameter platform; and a variable vane airfoil rotatably attached to and extending between the first inner diameter platform and the first outer diameter platform such that at least a portion of the vane airfoil extends beyond a periphery of at least one of the first inner diameter platform and the first outer diameter platform;

wherein the vane airfoil is a portion of a variable vane assembly having a shaft, the vane airfoil being attached to the shaft such that the airfoil rotates with the shaft;

wherein the variable vane assembly further comprises a pillow block attached to the shaft; and wherein the first outer diameter platform is operative to mount the pillow block.

13. A gas turbine engine comprising:

a compressor;

a combustion section operative to receive compressed air from the compressor; and a turbine operative to drive the compressor, the turbine having a vane assembly;

the vane assembly comprising:

a first inner diameter platform;

a first outer diameter platform spaced from the first inner diameter platform, which first outer diameter platform has an inner diameter surface and a recess located in the inner diameter surface; and a variable vane airfoil rotatably attached to and extending between the first inner diameter platform and the first outer diameter platform such that at least a portion of the vane airfoil extends beyond a periphery of at least one of the first inner diameter platform and the first outer diameter platform, wherein a tip of the vane airfoil extends into the recess, and wherein the tip comprises an airfoil cross-sectional geometry.

14. The engine of claim 13, wherein:

the vane airfoil is a first vane airfoil; and the assembly further comprises a second vane airfoil extending between the first inner diameter platform and the first outer diameter platform.

15. The engine of claim 14, wherein the vane airfoil is removably attached to the vane assembly.

16. A gas turbine engine comprising:

a compressor;

a combustion section operative to receive compressed air from the compressor;

a turbine operative to drive the compressor, the turbine having a vane assembly comprising:

a first inner diameter platform;

a first outer diameter platform spaced from the first inner diameter platform, which first outer diameter platform has an inner diameter surface and a recess located in the inner diameter surface; and a variable vane airfoil rotatably attached to and extending between the first inner diameter platform and the first outer diameter platform such that at least a portion of the vane airfoil extends beyond a periphery of at least one of the first inner diameter platform and the first outer diameter platform wherein a tip of the vane airfoil extends into the recess, and wherein the tip comprises an airfoil cross-sectional geometry;

a second inner diameter platform; and a second outer diameter platform spaced from the second inner diameter platform;

the second inner diameter platform being positioned adjacent to the first inner diameter platform such that an inner platform gap is formed therebetween;

the second outer diameter platform being positioned adjacent to the first outer diameter platform such that an outer platform gap is formed therebetween; and the vane airfoil spanning across at least a portion of the inner platform gap and across at least a portion of the outer platform gap.

17. A variable vane for a gas turbine engine comprising:

a hollow shaft extending between a first end and a second end, and including a tapered spline; and a vane airfoil attached to the shaft between the first end and the second end;

wherein the tapered spline is located between the airfoil and the second end, and is configured such that a narrow portion of the spline is located toward the second end.

* * * * *